US008262421B2

(12) United States Patent
De Blieck et al.

(10) Patent No.: US 8,262,421 B2
(45) Date of Patent: Sep. 11, 2012

(54) CONTACT FOR ELECTRICAL CONNECTOR

(75) Inventors: Roland Tristan De Blieck, Oss (NL); Peter Poorter, Wijk en Aalburg (NL)

(73) Assignee: FCI, Versailles (FR)

( * ) Notice: Subject to any disclaimer, the term of this patent is extended or adjusted under 35 U.S.C. 154(b) by 101 days.

(21) Appl. No.: 12/449,699

(22) PCT Filed: Feb. 22, 2008

(86) PCT No.: PCT/IB2008/001566

§ 371 (c)(1),
(2), (4) Date: Nov. 16, 2009

(87) PCT Pub. No.: WO2008/102276

PCT Pub. Date: Aug. 28, 2008

(65) Prior Publication Data

US 2010/0075545 A1 Mar. 25, 2010

(51) Int. Cl.
*H01R 13/415* (2006.01)

(52) U.S. Cl. ..... 439/741; 439/879; 439/357

(58) Field of Classification Search ..... 439/466, 439/741, 891, 879, 357
See application file for complete search history.

(56) References Cited

U.S. PATENT DOCUMENTS

| | | | | |
|---|---|---|---|---|
| 4,209,221 | A * | 6/1980 | Chupak et al. | 439/848 |
| 4,291,934 | A * | 9/1981 | Kund | 439/421 |
| 5,181,867 | A * | 1/1993 | Rodondi et al. | 439/854 |
| 5,203,726 | A * | 4/1993 | Quinn | 439/867 |
| 5,207,603 | A | 5/1993 | Peloza | 439/884 |
| 6,276,960 | B1 * | 8/2001 | Schaefer et al. | 439/522 |
| 6,962,504 | B2 * | 11/2005 | Fukui et al. | 439/466 |
| 7,121,884 | B2 * | 10/2006 | Osada | 439/582 |
| 2002/0013099 | A1 | 1/2002 | Adkins et al. | 439/625 |

* cited by examiner

*Primary Examiner* — Hien Vu
(74) *Attorney, Agent, or Firm* — Harrington & Smith

(57) ABSTRACT

The present invention relates to contact, including a mating end for mating to two or more contacts and a conductive section. The conductive section includes a crimping end which is adapted to receive an electrical conductor and for being crimped thereto and a shaft section which extends between the crimping end and the mating end and includes two legs.

17 Claims, 13 Drawing Sheets

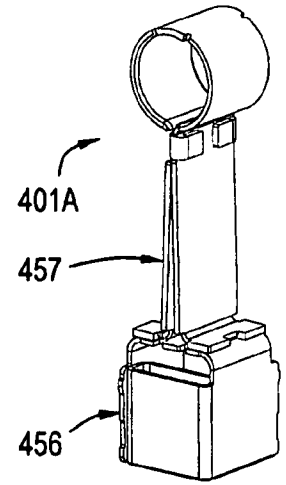
Fig. 10A
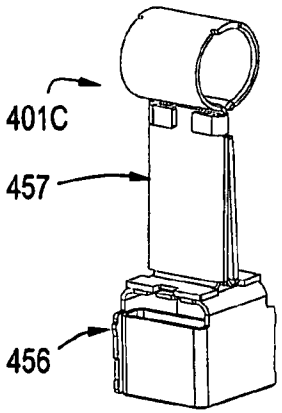
Fig. 10B
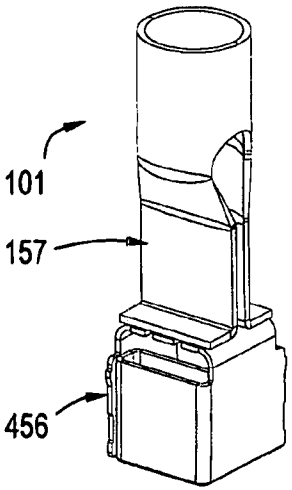
Fig. 10C
Fig. 10D
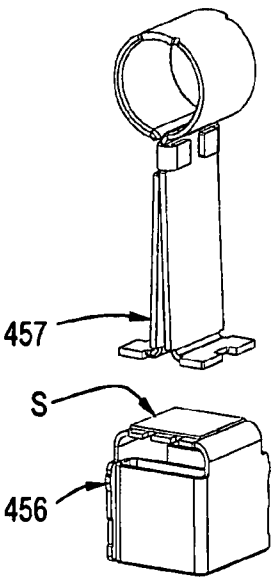
Fig. 10E
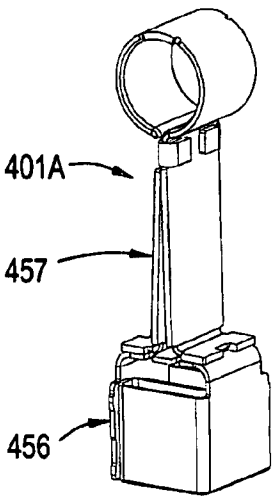
Fig. 10F

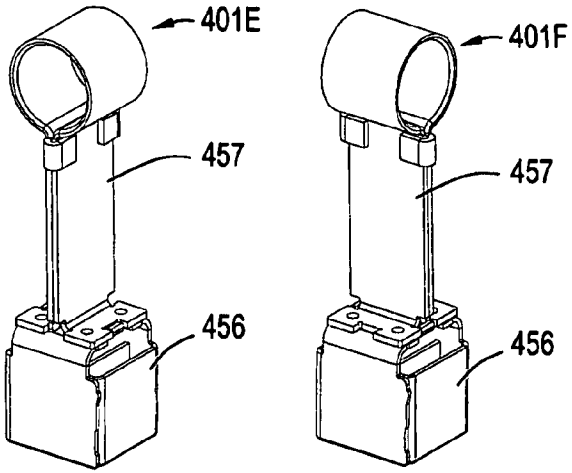
Fig. 21A
Fig. 21B
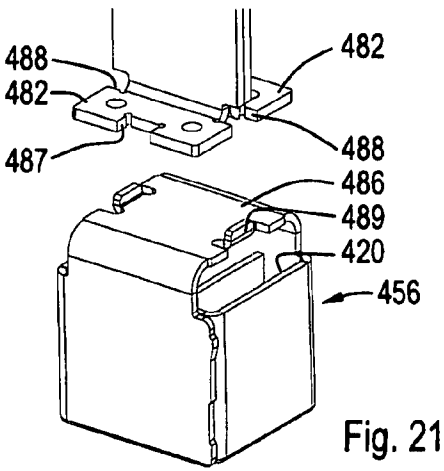
Fig. 21C
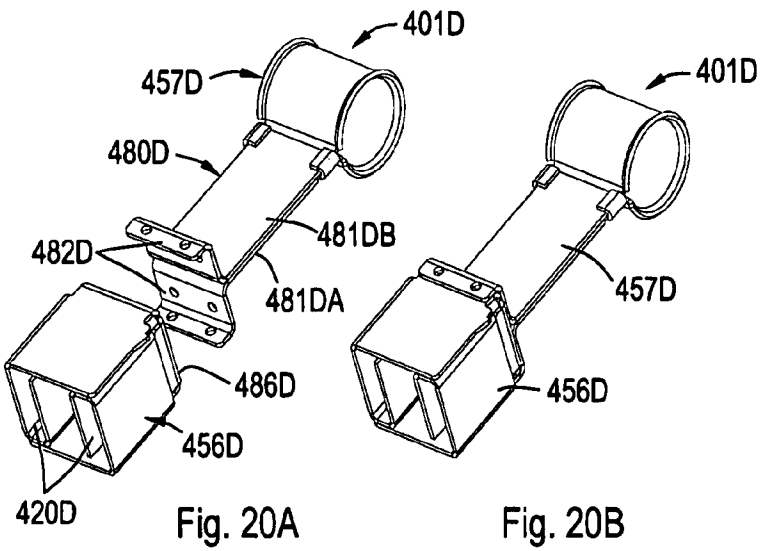
Fig. 20A
Fig. 20B

CONTACT FOR ELECTRICAL CONNECTOR

FIELD OF THE INVENTION

The invention relates to an electrical connector contact. In particular, the invention relates to connectors and connector contacts for transmitting relatively high currents and powers.

BACKGROUND OF THE INVENTION

Electrical connectors, especially electrical connectors designed and configured for transmitting power may have to meet competing and sometimes conflicting demands, e.g. relatively high power transfer, small size, close and stable packing of contacts in a single connector housing and the prevention of heat build-up, as a result of e.g. resistive losses. Especially for transmission of high currents, such as several tens of Amperes, e.g. 50 A or more, and/or high powers, such as 1000 Watts or more, small electrical resistances may cause high temperatures of the contacts of such connectors, which in return may further increase their resistance.

A contributing factor to heating of a contact of a cable connector is the contact resistance between the contact and the countercontact as well as between the contact and (the conductor of) the cable. Furthermore, with cable connectors, it may happen that the cable, instead of the connector or the contact is pulled, e.g. for unmating or by accident.

A cable connector for transmitting power should thus be compatible with such dimensional, thermal and mechanical constraints. Preferably, a connector should stand prolonged use (on the order of several years) and not suffer aging effects, such as increasing resistance.

Another important factor is the manufacturing costs of the connector and the contacts.

Consequently, there is a desire for an improved power connector for carrying a relatively high current and/or power and a contact therefor which may reduce or substantially prevent high temperatures from occurring and which may be manufactured relatively cost-efficiently.

SUMMARY OF THE INVENTION

In one aspect of the invention a power connector contact for carrying a relatively high current and/or power is provided, comprising a mating end for mating to two or more contacts and a one-piece conductive section. The conductive section includes a crimping end which is adapted to receive at least an end of an electrical conductor and for being crimped thereto and a shaft section. The shaft section extends between the crimping end and the mating end and includes two legs.

Such contact may efficiently be connected to a conductor by crimping. The contact can connect one conductor to two or more contacts of a counterconnector, which is relatively material and space efficient since cables of a given physical size generally may carry higher currents and powers than contacts of the same size. The crimping section may be adapted to receive an end of a plurality of electrical conductors, e.g. of a plurality of cables, and for being crimped thereto. The manufacturing of at least a portion of the contact by folding is a relatively efficient process with respect to material usage and/or manufacturing operations. The shaft section including two legs provides relatively much conductive material between the crimping end and the mating end, thus providing a relatively low resistance of the contact. This reduces or prevents heating of the contact. Providing more material to a conductor reduces its resistance. The legs are therefore preferably relatively wide.

Claim 8 defines a second aspect of the invention, being a power connector contact for carrying a relatively high current and/or power is provided, comprising a first member and a second member which are mounted to each other, such as by a soldered connection or ultra sonic welding. The first member forms a front mating end of the contact and the second member forms a rear end of the contact. The second member has a crimping end which is adapted to receive at least an end of an electrical conductor and to be crimped onto the conductor.

This connector is modular and allows efficient manufacturing of differently shaped contacts, e.g. providing different relative orientations of the crimping end and the mating end, which is particularly useful in combination with a mating end for mating two or more connector contacts. A modular contact allows for specifically adapting the members to different requirements, e.g. with respect to the contact interface for the mating end and to the mechanical properties of the crimping barrel.

The members are preferably mounted to each other with a relatively large contact surface for reducing contact resistance.

The contact of claims 2 and 11, respectively, allow relatively efficient manufacturing of the mating end with respect to material usage and/or manufacturing operations.

The contact of claim 3 allows relatively efficient manufacturing of the entire contact, such as by folding. Having a one-piece contact prevents contact resistances within the contact at boundaries between constituent members.

The contact of claim 4 is modular and allows relatively efficient manufacturing of differently shaped contacts as set out with respect to claim 8.

The contacts of claims 5 and 12, respectively, facilitate the assembly and mounting of the contacts of claims 4 and 8-11, respectively.

The legs of the contact may be fixed to each other at one or more positions for providing a relatively robust contact. Arranging a portion of the legs with a separation between the legs may increase heat exchange to surrounding air for increased cooling of the contact.

The contacts of claim 6 or 10, respectively, allow fixing the legs to each other relatively efficiently.

The contacts of claim 7 or 14, respectively, allow trapping and fixing the contact with respect to the cover.

Claim 15 defines another aspect of the invention, being a power connector contact for carrying a relatively high current and power, comprising a mating end for mating to two or more contacts, a crimping end and a shaft section. The crimping end is adapted to receive at least an end of an electrical conductor and for being crimped thereto. The shaft section extends between the crimping end and the mating end and includes two legs. The contact is a single folded piece of material.

Such a connector contact may be manufactured relatively efficiently. By providing the shaft section with two legs, the contact provides relatively much material between the crimping end and the mating end, reducing resistance of the contact and therewith reducing heating effects. The contact can efficiently connect one or more cables with one or more contacts.

Claim 16 defines yet another aspect of the invention, being a power connector contact for carrying a relatively high current and power comprising a first member and a second member which are mounted to each other, such as by a soldered connection or ultra sonic welding. The first member forms a front mating end of the contact and the second member forms a rear end of the contact. The first member is a single folded piece of material adapted for mating to two or more contacts.

The second member has a crimping end and a shaft section. The crimping end is adapted to receive at least an end of an electrical conductor and to be crimped onto the conductor. The shaft section extends between the crimping end and the mating end and includes two legs.

Such a connector contact may be manufactured relatively efficiently by forming each member in a suitable manner such as by folding, and assembling the contact in a desired manner, such as in a desired relative orientation. By providing the shaft section with two legs, the contact provides relatively much material between the crimping end and the mating end, reducing resistance of the contact and therewith reducing heating effects.

Another aspect of the invention is a method for manufacturing a power connector contact, comprising the steps of providing a piece of conductive material, e.g. a sheet of metal, forming a first portion of the material, e.g. by folding, into a crimping end which is adapted to receive an electrical conductor and for being crimped thereto, and a shaft section which includes two legs, and forming a second portion of the material into a mating end adapted for mating to two or more contacts.

This allows manufacturing a contact capable of connecting one cable to two contacts. The crimping end may be adapted for receiving a plurality of conductors, e.g. a plurality of cables.

The crimping end and the shaft section may be formed by providing a strip of a conductive material, e.g. metal, having a central portion located between two outer portions and folding the strip such that the outer portions are arranged essentially parallel to each other, therewith forming a shaft section having two legs, and such that the central portion forms a crimping end, such as a crimping barrel, at one end of the shaft portion, thus forming an essentially Ω-shaped structure. In such an Ω-shaped structure, the legs may optionally be held together fixedly, e.g. by soldering, (spot) welding or with the tab defined in claim 6, relatively close to the crimping end. This may prevent the legs from opening and assists maintaining integrity and/or robustness of the crimping barrel during and after crimping the contact to a cable.

Yet another aspect of the invention is a method for manufacturing a power connector contact comprising the steps of providing a piece of conductive material, forming it, e.g. by folding, into a first member forming a front mating end, providing a piece of conductive material, forming it, e.g. by folding, into a second member forming a crimping end which is adapted to receive an end of an electrical conductor and for being crimped thereto, and a shaft section which includes two legs, and mounting the first and second members to another, such as by soldering or welding.

This method provides a modular power contact which may be assembled in a desired way, e.g. for suitably orienting the crimping end to the mating end. This is particularly useful in combination with a mating end adapted for mating to two or more contacts.

A connector comprising a connector contact according to any one of the claims 1-16 thus may carry a relatively high current and/or power and may reduce or substantially prevent high temperatures from occurring. It may also be manufactured relatively cost-efficiently.

The connector of claim 20 is relatively robust, since the contact is trapped with respect to the housing as well as with respect to the cover. Thus, (pulling) forces on the cable and thus on the contact are generally prevented from pulling the contact out of the cover, exposing a contact. The connector also facilitates alignment of the contact with respect to the cover and the terminal housing and thus facilitates its assembly.

BRIEF DESCRIPTION OF THE FIGURES

In the drawings:

FIGS. 10A-10C show different contact types;

FIGS. 10D-10F show a method of assembly of a contact;

FIGS. 20A-23B show manufacturing stages of contact embodiments; the groups of FIGS. 20A-20B, 21A-21B, 22A-22F and 23A-23B corresponding to different embodiments.

DETAILED DESCRIPTION OF EMBODIMENTS

Figure 1:
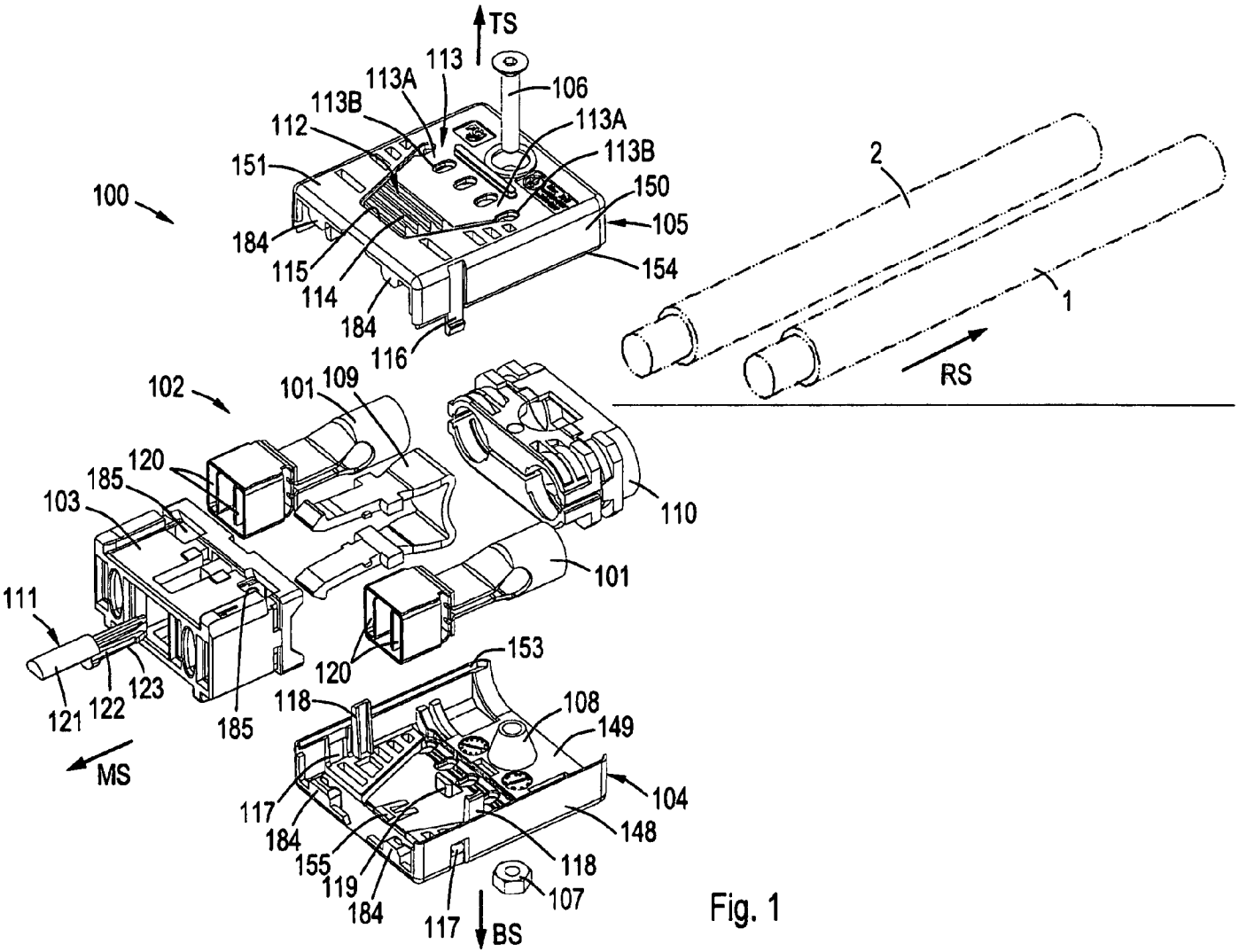
FIG. 1 is an exploded perspective view of a connector.

Referring to FIG. 1, there is shown an exploded perspective view of an electrical connector 100 incorporating features of the invention. Although the invention will be described with reference to the exemplary embodiments shown in the drawings, it should be understood that the invention can be embodied in many alternate forms of embodiments. In addition, any suitable size, shape or type of elements or materials could be used. Further, elements and/or aspects discussed with respect to one embodiment may be suitably combined with those of another embodiment.

FIG. 1 shows a straight cable plug connector 100, adapted for mating with a receptacle mating connector such as the board connector 200 discussed below with respect to, e.g., FIG. 3. The connector 100 generally has a front side or mating side MS, a rear side RS, a top side TS and a bottom side BS, the directions being indicated with arrows.

In the following, substantially corresponding or identical parts and portions of different embodiments are indicated with substantially the same reference numerals.

It should be noted that definitions of orientations and/or sides are mainly for ease of reference and correspond to the parts as shown in the Figures, they should not be construed limiting the disclosure.

The electrical connector 100 is a power connector adapted to removably connect electrical conductors 1, 2 to another electrical connector. The electrical connector 100 generally comprises electrical contacts 101, a housing 102 including a terminal housing 103 and covers 104, 105, fasteners 106, 107, which are accommodated in fastener conduits 108, a locking spring 109, a strain relief member 110, and a coding key 111.

The cover portions 104 and 105 of the connector 100 comprise deflectable latch portions 112 with a rear end or base 113, and with finger gripping structures 114 and a front end 115 with an inside ledge 155. The base 113 comprises base portions 113A and holes 113B. The connector 100 further comprises structures for snap locking the covers 104 and 105 to each other in the form of snap lock latches 116, corresponding reception apertures 117 and supporting ribs 118. On the interior side of the covers 104, 105 protrusions 119 are provided for supporting the locking spring 109. Additional protrusions 184 are arranged for being received in holes 185 in the terminal housing 103, as will be explained below with respect to FIG. 7.

The shown contact terminals or contacts 101 are configured for receiving an electrical conductor 1, 2 and for being crimped thereto. The contacts 101 are female contacts, each having two substantially parallel contact receiving sections 120 for receiving male contacts of a mating connector, e.g. contact pins or blades.

The orientation of the coding key 111 with respect to the terminal housing 103 may determine correct mating between the connector 100 and a mating connector. The coding key 111 has a front keying portion 121, an intermediate portion 122 and a rear mounting portion 123 arranged along a longitudinal axis.

The contact according to the invention could also be used in a signal connector or a combined signal and power connector. The contact can especially be used in a "high power" input/output (IO) system, such as 100 Amperes by 20 DC Volts or 25 Amperes by 80 DC Volts for example. The design can use PWR BLADE® contacts (such as those described in U.S. Pat. No. 7,309,242). A general trend is higher current carrying capacity per pin in order to meet high density and still be able to supply high currents to the various components within a system. 2000 Watts at 100 Amperes is not an unusual requirement. The board connector 200 (cf. FIG. 3) may have four generic PWR BLADE® contacts to drive the positive and negative poles of the power (2 contacts per pole) and may have a dedicated housing to provide a robust I/O connector system with touch-proof walls and coding in at least four orientations, e.g. defined by a coding key.

Figure 3:
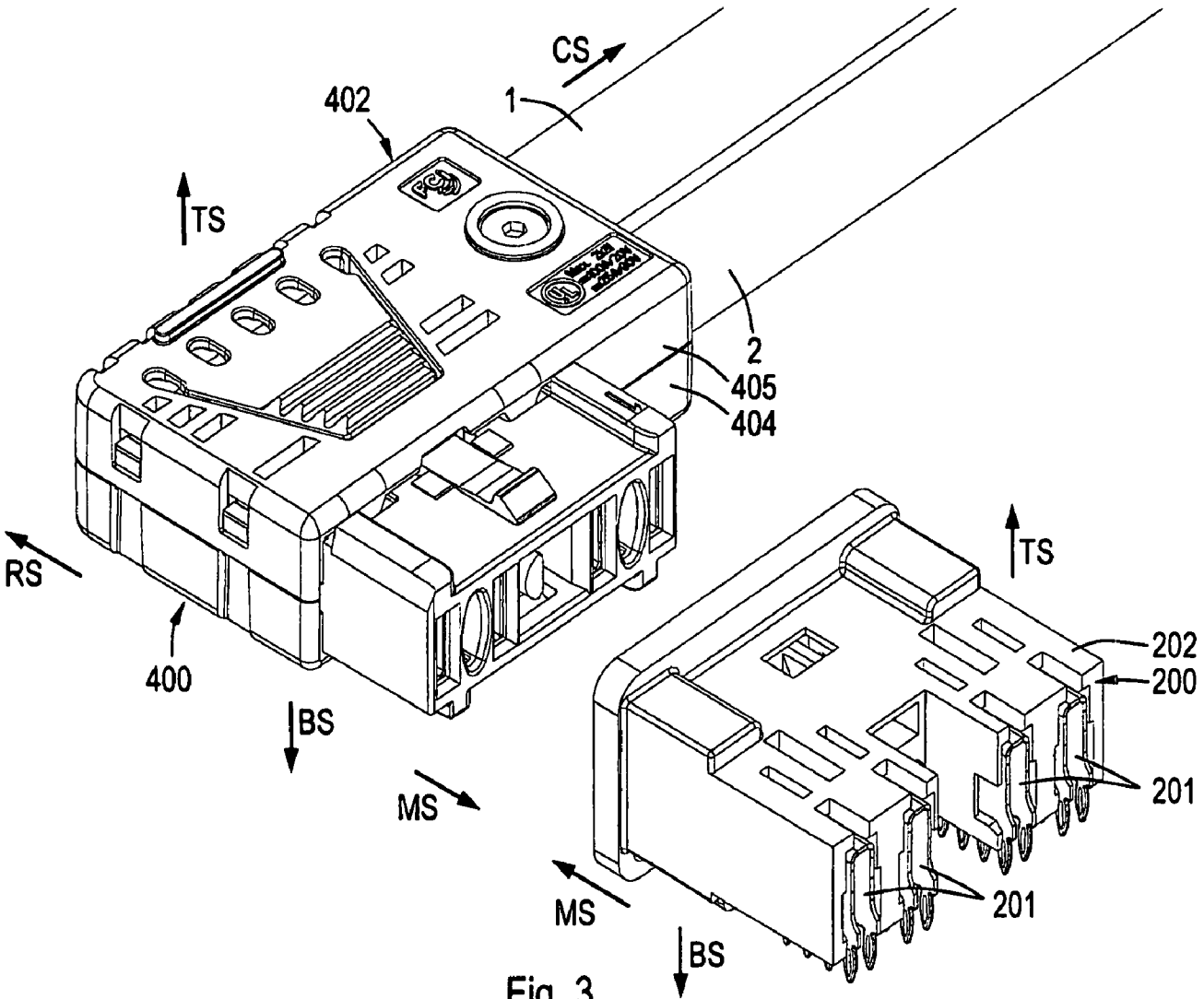
FIG. 3 shows a right angle connector and a mating connector.

Referring also to FIG. 3, the mating connector 200 is shown with a right angle plug connector 400 comprising features of the invention. This illustrates that the mating connector 200 can be used with either the straight connectors 100 or the right angle connector 400.

Figure 2B:
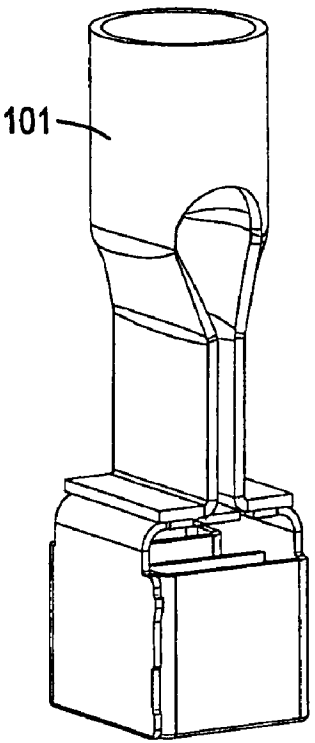
FIGS. 2A-2B show a contact and its assembly.
Figure 2A:
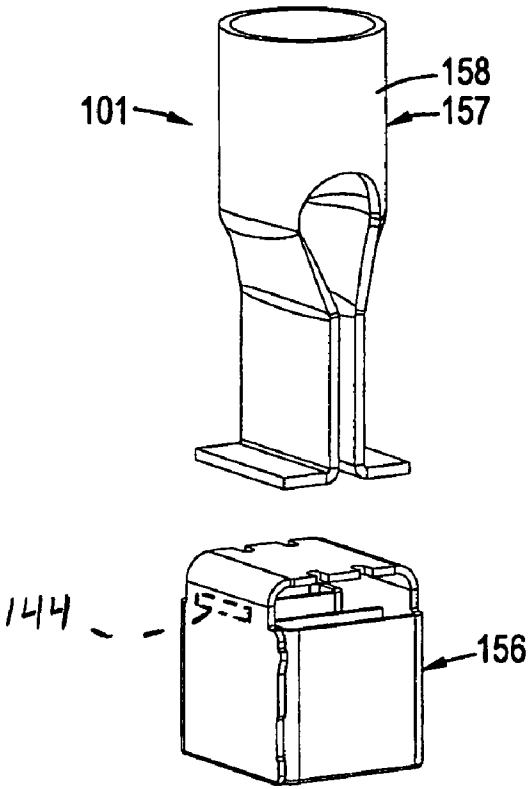
Figures 4, 5:
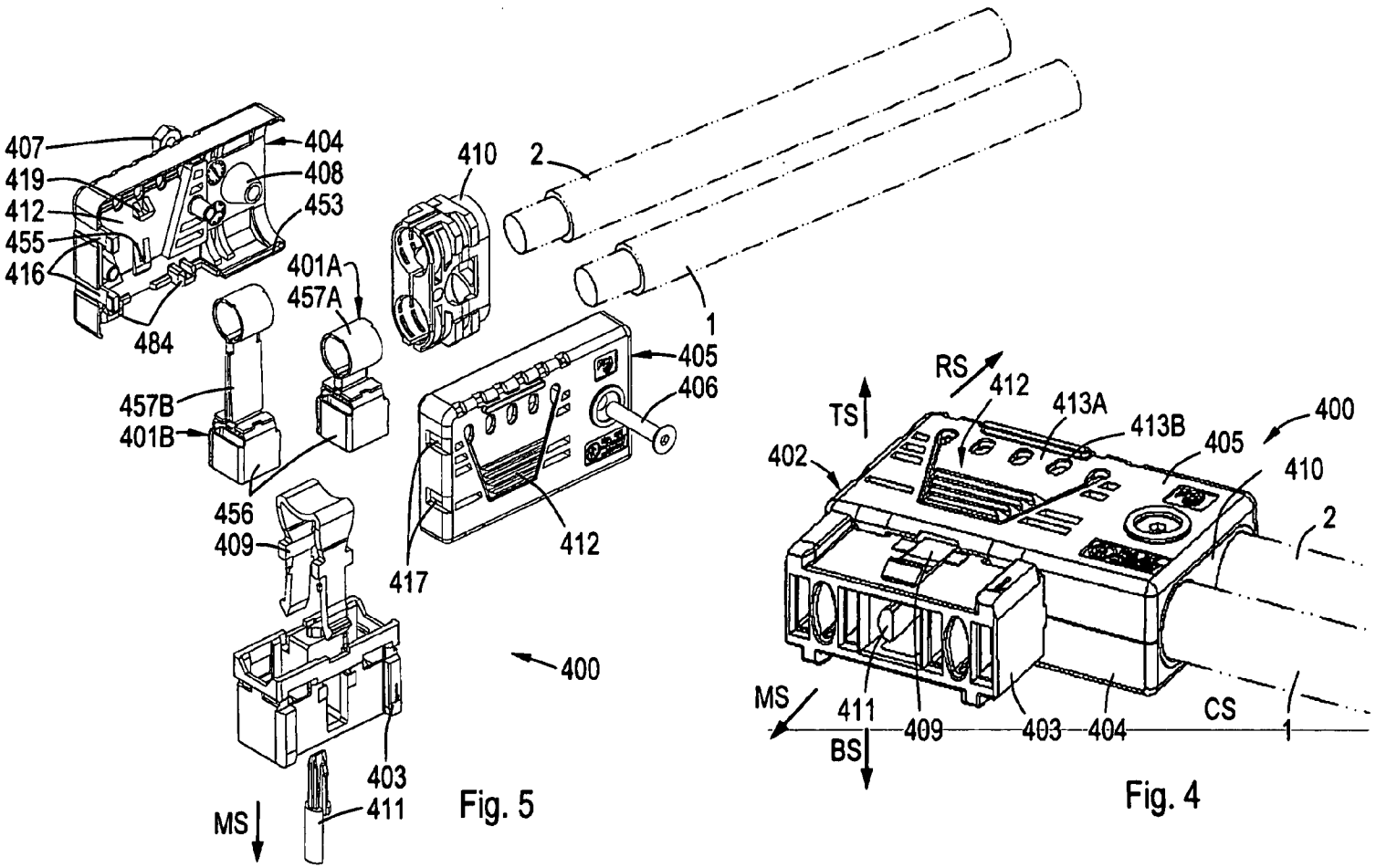
FIGS. 4 and 5 are a perspective view and an exploded perspective view, respectively, of the connector of FIG. 3.

Referring now to FIGS. 1 and 2A-2B, the electrical contacts 101 each generally comprise two members 156, 157 which are mounted one on the other, such as by a soldered connection or ultra sonic welding. However, in alternate embodiments any suitable type of electrical contacts may be provided. The first member 156 forms the front mating end of the contact and the second member (or conductive section) 157 forms the rear end of the contact. The rear end 157 has a barrel section 158 which is adapted to receive an end of one of the electrical conductors 1. The barrel section 158 can then be crimped onto the conductor. The electrical contacts 101 and alternatives will be discussed in more detail below Referring also to FIGS. 3-5, the connector 400 generally comprises a mating side MS, an opposite rear side RS, a top side TS and a bottom side BS. The lateral side from which the conductors or cables 1, 2 extend from the housing 402 is referred to as cable side CS. The connector 400 further generally comprises electrical contacts 401A, 401B a housing 402 including a terminal housing 403 and covers 404, 405, fasteners 406, 407, a locking spring 409, a strain relief member 410, and a coding key 411. The contacts 401A, 401B comprise first members 456 and second members 457A, 457B, to be discussed hereafter. The constituent parts of the connector 400 are substantially identical to those of the straight connectors 100, 300 apart from the contacts 401A, 401B and the covers 404, 405. However, these parts 401A, 401B, 404, 405 are functionally substantially identical to their equivalent parts 101, 104, 105 (301, 304, 305), as also discussed in more detail below.

Figure 6B:
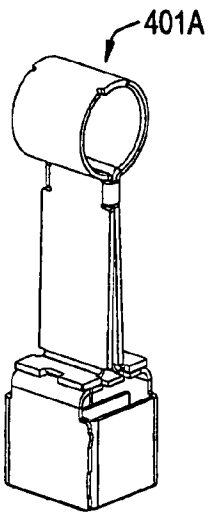
FIGS. 6A, 6B show stages of manufacturing a contact.
Figure 6A:
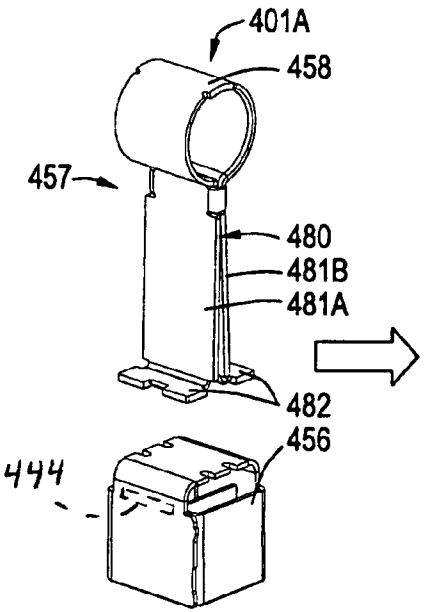

Referring now to FIGS. 6A and 6B, a general right angle contact 401 is shown. Like the contact 101 (cf. e.g. FIGS. 2A, 2B), the contact 401 generally comprises two members 456, 457 which are mounted one on the each other, such as by a soldered connection or ultra sonic welding. The first member 456 forms the front mating end of the contact and the second member 457 forms the rear end of the contact (or conductive section). The rear end 457 has a barrel section 458 which is adapted to receive an end of one of the electrical conductors 1, 2.

The barrel section 458 can then be crimped onto the conductor. The rear end 457 further has a shaft section 480.

Figures 8, 9A, 9B, 9C, 9D:
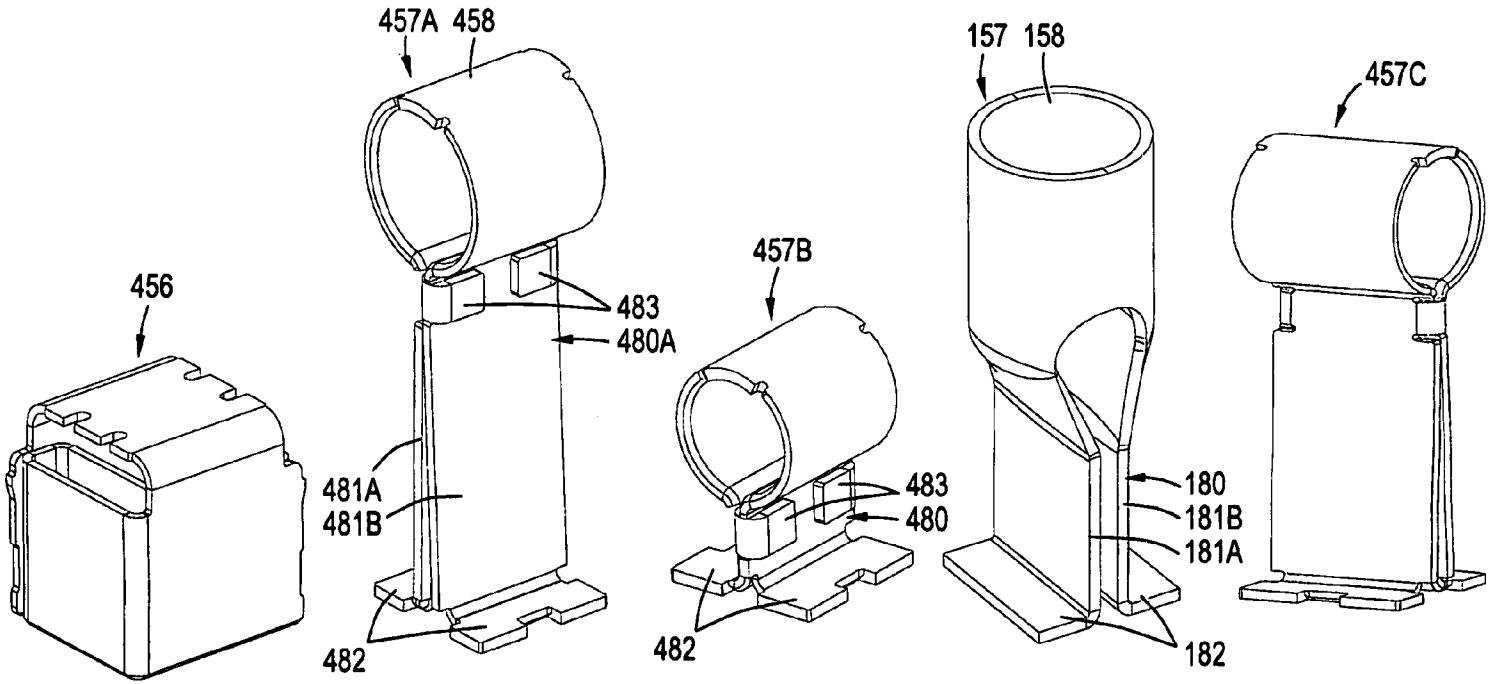
FIG. 8 shows a mating portion of a contact.
FIGS. 9A-9D show different crimping portions of a contact.

Referring also to FIGS. 5, 6A, 6B and 8-9B, the contacts 401A, 401B are substantially the same except for the length of the shafts 480A, 480B from the barrels 458A, 458B. Each shaft 480 of the conductive section includes two substantially parallel legs 481A and 481B provided with connection portions or feet 482. Each contact 401A, 401B has a front end member 456 and a rear end member 457A or 457B. The rear end members 457A and 457B are only different based upon the length of their shafts 480A, 480B from their barrels 458A, 458B (see FIGS. 9A, 9B). The two members 456, 457A or 457B are mounted one on the each other, such as by a soldered connection or ultra sonic welding, as indicated in FIGS. 46A, 46B. It should be also noted that one of the legs 481A of the shaft 480 comprises at least one foldable tab 483, near the barrel section 458, as best seen in FIGS. 9A, 9B. In the present embodiments shown, the leg 481A comprises two foldable tabs 483, extending from opposite lateral side edges of said leg 481A. The tabs 483 of leg 481A are folded and clipped on the leg 481B (optionally, the tabs may be further welded onto the leg) so as both legs 481A, 481B are firmly held together to prevent said legs from opening. These tabs 483 help create the crimp barrel 458. However, in alternate embodiments any suitable type of electrical contacts could be provided. The first member 456 forms the front mating end of the contact 401 and the second member 457A or 457B forms the rear end of the contact. The rear end 457 has a barrel section 458 at a right angle to the shaft section 480 which is adapted to receive an end of one of the electrical conductors 1, 2. The barrel section 458 may then be crimped onto the conductor. In an alternate embodiment, the barrel section 458 may be adapted to receive an end of two or more conductors.

Figure 7:
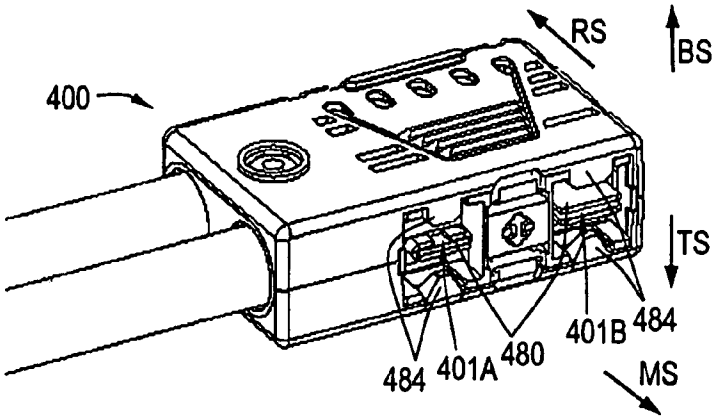
FIG. 7 is a perspective view, partially broken away, of the right-angle connector of FIGS. 3-5.

FIG. 7 is a perspective view of the connector 400, in partially broken away along the mating sides of the covers 404, 405, thus showing a cross section of the terminal housing 403 with the terminals 401A, 401B therein.

As shown in FIG. 7, the covers each have two protrusions 484 which penetrate through the terminal housing through holes provided therein and position themselves above the soldered ends of the second members at a position along the shafts in between the crimp barrels and the respective feet to trap the terminals 401A, 401B inside their cavities of the housing. Additional features on the covers 404, 405 can press against the legs 481A, 481B to position and center the crimp section 458 of the contact in the connector.

Thus, with the invention a two-piece terminal or contact 101, 401 for flexibility and different cable exits can be used. Since the use of the invention can provide several cable connector versions 100, 400 with cable exits in different directions, it was decided to make the terminal from two parts which could be soldered or welded together. One member being a rectangular contact blade and a crimp barrel which would match the cable direction, e.g. along its direction of extension from the connector housing and/or the cable clamp 110, 410 and which could be positioned onto the contact box, being a second member, in four different ways, each 90 degrees apart from one other.

In addition, trapped terminals 101, 401 for connector robustness can be provided. Protrusions 184, 484 of the cable connector covers 104, 105; 404, 405 can penetrate through openings 185, 485 of the cable connector housing 103, 403 inside the region of the cavities 144, 444 for the terminals 101, 401 (see FIG. 2A for cavity 144, and FIG. 6A for cavity 444). The protrusions and terminals are formed in such a way that once all the components are in place the terminals 101, 401 are trapped by the protrusions 184, 484 and the terminals can only move upwards again over a limited amount of a few tens of a millimeter or less. If massive forces coming from the cable or cables 1-4 would pull onto the terminal 101, 401 via the crimp of the cable inside the barrel 158, 358, 458 of the terminal, then the protrusions 184, 484 of the covers can block the barrel and quote with these forces. This is a functionally which is certainly worth while having for the straight cable connector 100, 300, 500 because the centerline of the cable(s) 1-4 is in-line with the centerline of the contacts 101.

Referring also to FIGS. 8-10C, several variants of contacts are shown. FIGS. 10D-10F show a method of assembly of the contact.

Referring also to FIGS. 9 and 10A-10F, with the invention, the first member or contact box 456 can be used with at least four different second members 457A, 457B, 157 or 457C to form the electrical contacts 401A and 401B (e.g. FIGS. 5, 6A, 6B, 10A), 101 (e.g. FIG. 1) and a contact 401C (FIG. 10B) which is a 90 degrees rotated form of contact 401A (FIG. 10A) with respect to the relative orientation of the first member 456 and the second member 457. The directions of the crimp barrel sections 457, 157 with respect to that of the contact box 456 may e.g. be termed North/South (FIGS. 9A, 9B, 10A), East/West (FIGS. 9D, 10B) and straight (FIGS. 9C, 10C). FIGS. 11-23C show some other possible contact designs and formations as will be discussed hereafter.

Referring now to FIGS. 10D-10F, a contact may be manufactured by providing a contact section 456, e.g. stamping and forming, e.g. folding a piece of sheet material such as a metal, and providing a one-piece conductive (crimping) section 457, e.g. stamping and forming a piece of sheet material such as a metal in a general Ω-shape. Next the sections 456, 457 are positioned with respect to each other (FIG. 10D) and a solder pre-form S is placed in-between the sections 456, 457, e.g. on top of the contact section (FIG. 10E). Then the parts 456, 457 are brought together, and heat is added for soldering the parts together to form a contact 401A (FIG. 10F). The steps of FIGS. 10D and 10E may be inverted.

The invention shows how to connect one cable to two contacts of a mating connector, such as to two power blade contacts. This concept is based on making a one-piece solution made out of a sheet of a conductive material, e.g. metal. An option, shown in FIG. 51, is to provide one cable 1, 2 with two intermediate contact portions 5A, 5B; 5C, 5D, by crimping them with a ferrule 6 and by individually connecting these contact portions 5A-5D to connector contact terminals 7 to be fitted in a terminal housing 8. This results in relatively large numbers of individual parts and may complicate manufacturing.

Figure 11:
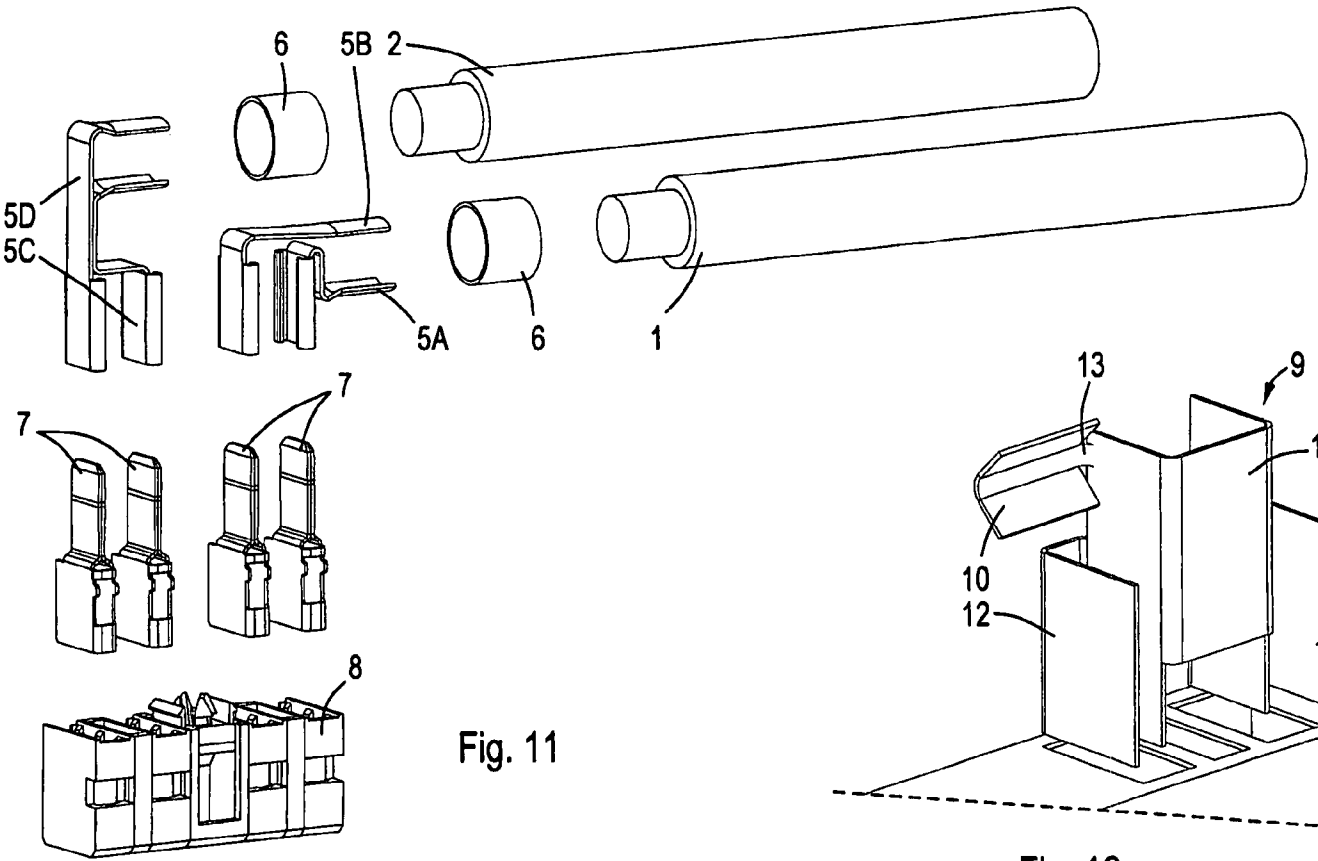
FIG. 11 is an exploded perspective view of an arrangement for contacting one conductor to two contacts.

According to an aspect of the invention, the two contacts and possibly the intermediate contact portions of FIG. 11 are replaced by a one-piece solution with two or more contact interfaces, e.g. similar to a power blade contact. Increasing the cross section of the conducting material between the conductor and a contact interface can be done by producing the contact out of one-piece and folding it. Thus, one will create more conductive cross section between the cable termination and the contact interfaces compared to a not-folded contact to increase the current rate capacity of the contact. Examples of such unitary contacts are shown in FIGS. 12, 13-15, and 16.

Figure 12:
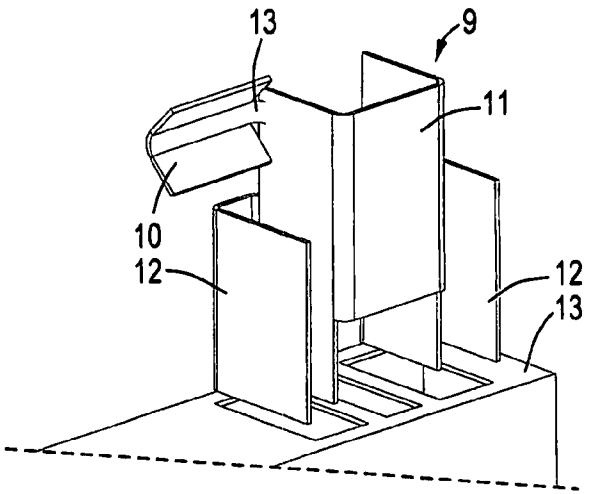
FIG. 12 shows a unitary, folded contact for contacting one conductor to two contacts.

FIG. 12 shows a relatively simple folded contact structure 9, providing a termination barrel or crimping portion 10, a transition area 11 and two contact portions 12 from a single folded sheet of material, e.g. metal, which may be mated with a mating connector 13. However, the crimping section 10 and the transition area 11 are connected with a relatively narrow connecting structure 13, which may act as a fuse.

Figure 15:
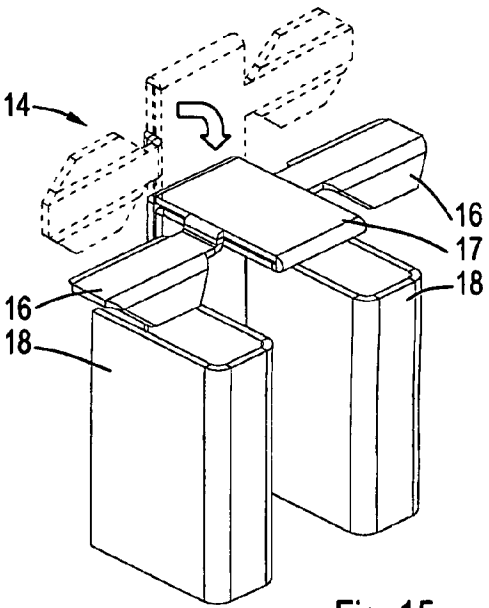
FIGS. 15 and 16 show alternative embodiments of a unitary contact for contacting one conductor to two contacts.
Figure 14:
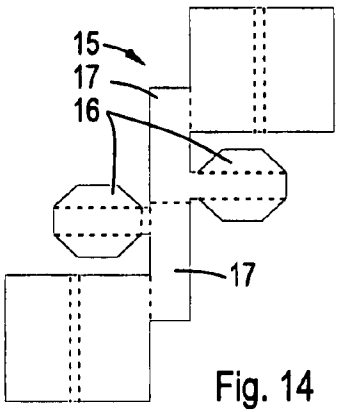
FIG. 14 shows a blank for the connector of FIG. 13.
Figure 13:
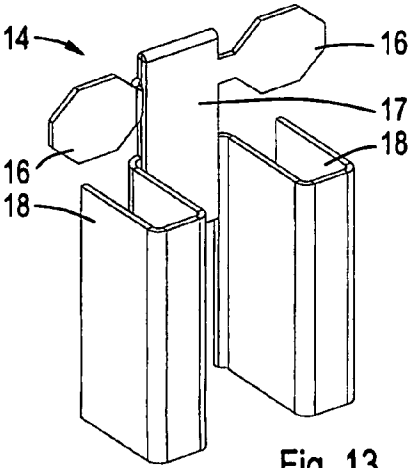
FIG. 13 shows another embodiment of a unitary, folded contact for contacting one conductor to two contacts.

FIGS. 13-15 show a further improvement. FIG. 13 shows a contact 14 comprising two crimping portions 16, a double layered transition area 17 and two contact portions 18. The double layered transition area 17 increases the cross section available for transporting power through the contact. The contact 14 may be manufacture by folding the single stamped blank 15 shown in FIG. 14 along the dotted folding lines; the resulting portions of the final contact are indicated in FIG. 14. A portion of the contact 14 comprising the crimping portions 16 and a portion of the transition area 17 may be folded further to reduce the overall volume of the contact (FIG. 15). Both crimping portions 16 are shown arranged substantially in a single plane and they may be used for crimping to a single conductor in parallel.

Figure 17:
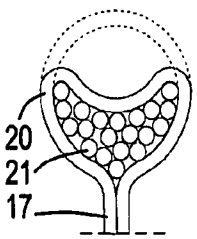
FIG. 17 indicates a crimped connection.
Figure 16:
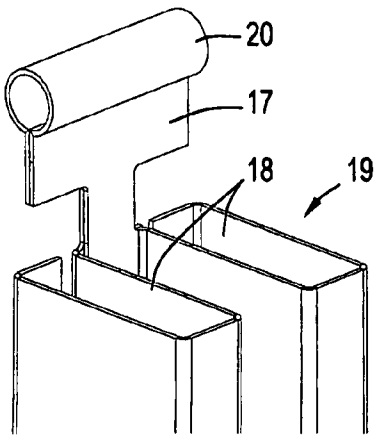

Another improvement is achieved by slightly modifying the design of the contact 14 to give contact 19 of FIG. 16. Here, a central portion of the transition area 17 and the crimping portions 16 are integrated to form a hollow crimping barrel 20. Such a generally tubular crimping barrel 20 provides a relatively good crimping contact, especially compared to a "U" shaped crimping cup. The crimped barrel 20 is schematically indicated in FIG. 17 in full lines, the original shape in broken lines. The black dots represent individual strands 21 of a conductor.

Figure 19:
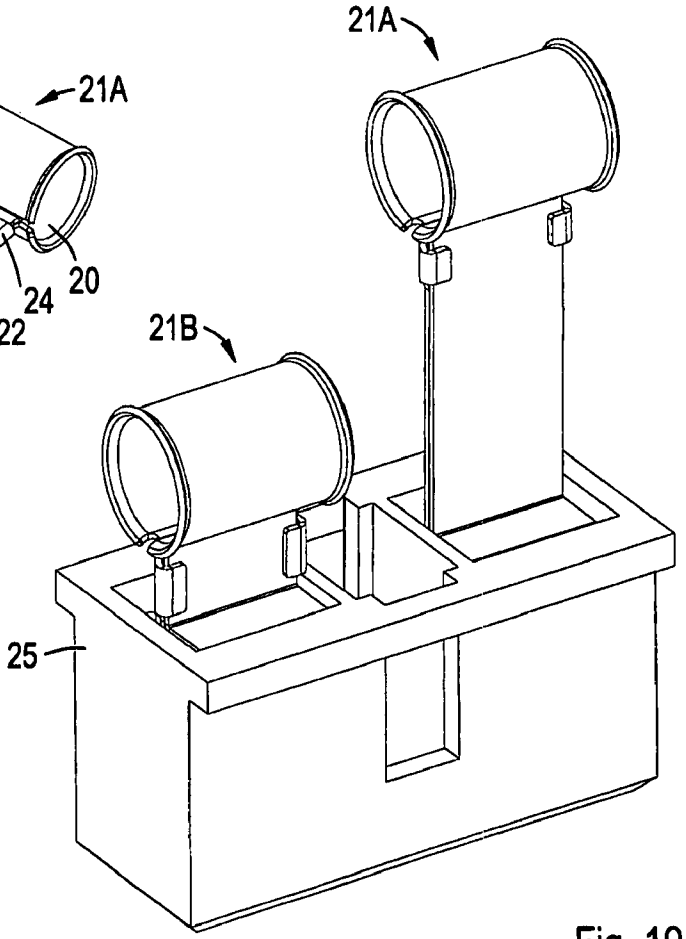
FIG. 19 shows the contacts and the housing of FIG. 18 in assembled state.
Figure 18:
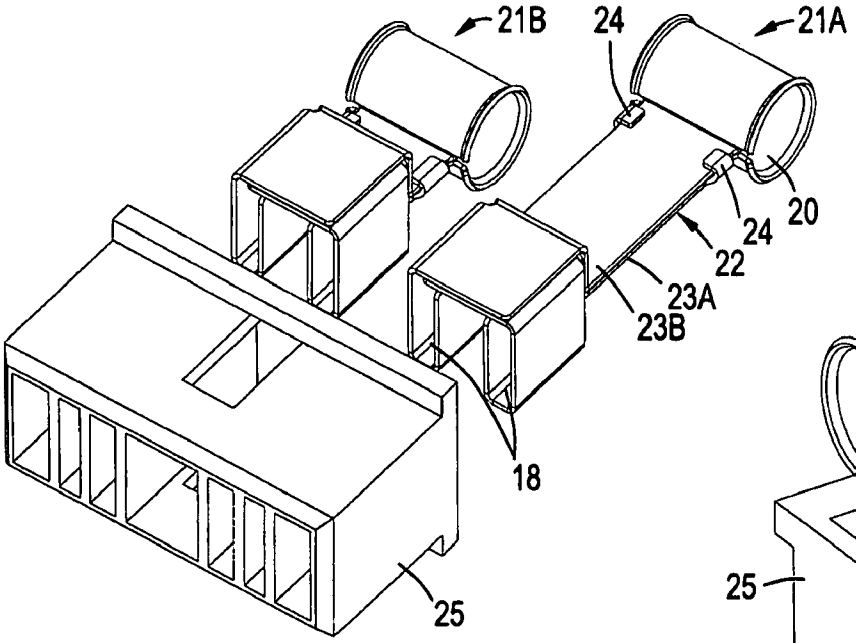
FIG. 18 is an exploded perspective view of two unitary folded contacts and a terminal housing.

Yet a further improvement is shown by the contacts 21A 21B in FIG. 18. The contacts 21A, 21B are unitary, folded contacts which are substantially similar to the contact 19, however the transition area 17 of each contact 21A, 21B is left the full width of the crimp barrel 20 from the barrel portion 20 to a section where the contact portions 18 are formed. Thus the available cross section for carrying power from one conductor to two contact portions 18 is further increased. As indicated with respect to contact 21A, the transition area 17 has been formed to a shaft section 22 having two legs 23A, 23B. The leg 23A comprises two foldable tabs 24, extending from opposite lateral side edges of said leg 23A for folding and clipped on the leg 23B and firmly holding together the legs to prevent them from opening. Thus, these tabs 24 help create the crimp barrel 458. As also shown in FIG. 19, the contacts 21A and 21B can be inserted in a terminal housing 25 for use in a right angle connector.

It should be noted that the entries to the crimp barrels 20 are flared for easy entry of the cable. In other embodiments, a chamfer on the inside edge of the crimp barrel may suffice.

FIGS. 20A, 20B and 21A-21C show modular contacts 401D 401E and 401F, respectively which are generally comparable to the contacts 401A and 401C of FIGS. 10A and 10C. FIGS. 20A and 20B show a contact 401D comprising a contact section 456D and a crimp section 457D. The contact section 456D is generally box-shaped and comprises a substantially closed top side 486D and a generally open mating side with two contact receiving channels 420D for mating to two male countercontacts. The crimp section 457D has a shaft section 480D with two legs 481DA, 481DB, each having feet 482D which are generally hook-shaped and oriented opposite each other. The opposite feet 482D form a structure which fits around the top side 486D of the contact section 456D for attaching the parts 456D and 457D and which may ensure a good alignment between the said parts. The parts 456D, 457D may also be mounted 90 degrees rotated (not shown). The feet have holes for soldering the parts 456D and 457D.

FIGS. 21A and 21B show contacts 410E and 401F, each comprising a contact box 456 and crimping sections 457E and 457F respectively, which are substantially identical except for the relative orientation of their constituent parts 456 and 457E or 457F. The sections 457E and 457F have feet 482E, 482F which are substantially flat.

FIG. 21 shows the top surface 486 of a contact box 456, having two contact receiving channels 420 and a portion of legs 481A, 481B and feet 482 of a section 457 in the orientation of FIG. 21B. It should be noted that each foot 482 has an aperture 487 and that in-between the feet 482F apertures 488 are provided. The top surface 486 of the contact box 456 comprises tabs 489 which are bent upwards. The apertures 487, 488 are configured for receiving the tabs 489 for assisting alignment of a part 457 to the contact box 456 in one of two general relative directions (North/South or East/West), providing either a contact 401E or a contact 401F. Other types of cooperating structures for mounting and/or alignment purposes may also be envisioned.

Figure 22B:
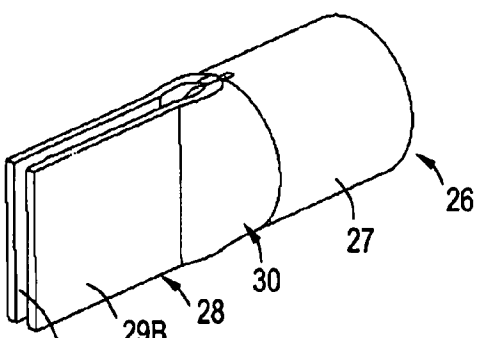
Figure 22C:
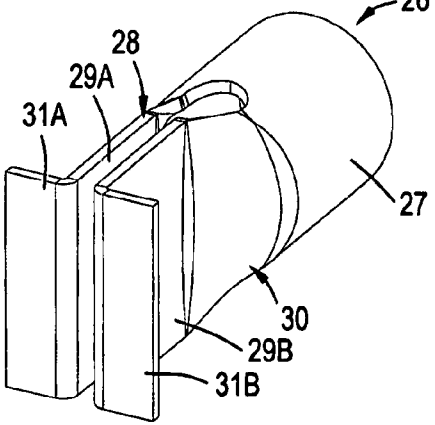
Figure 22D:
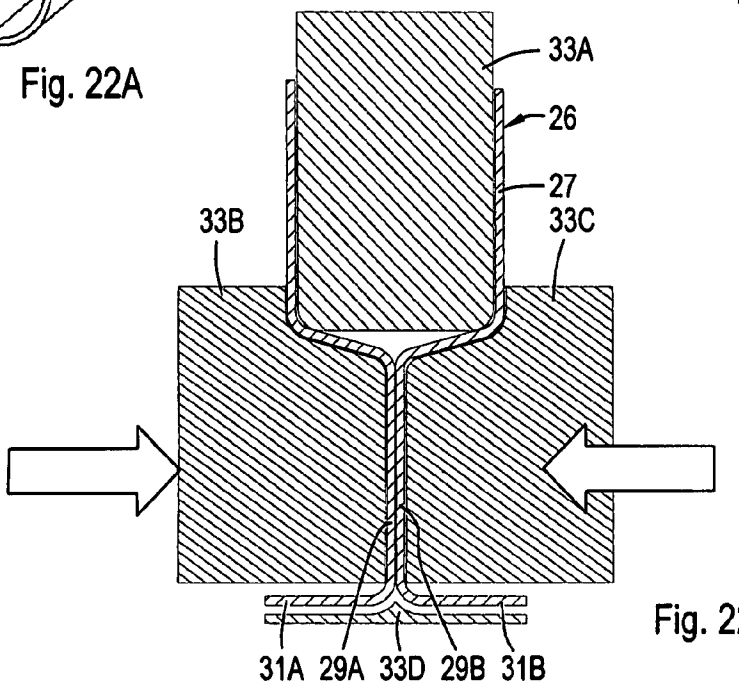
Figure 22A:
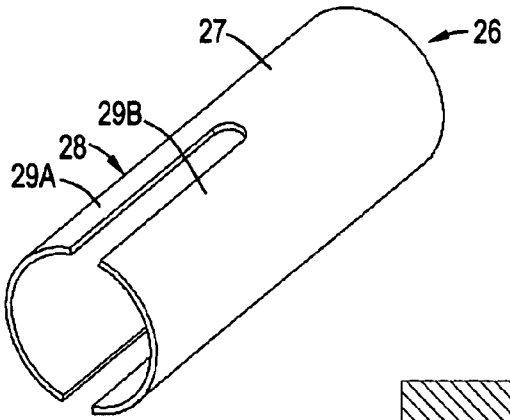
Figures 22E, 22F, 23A, 23B:
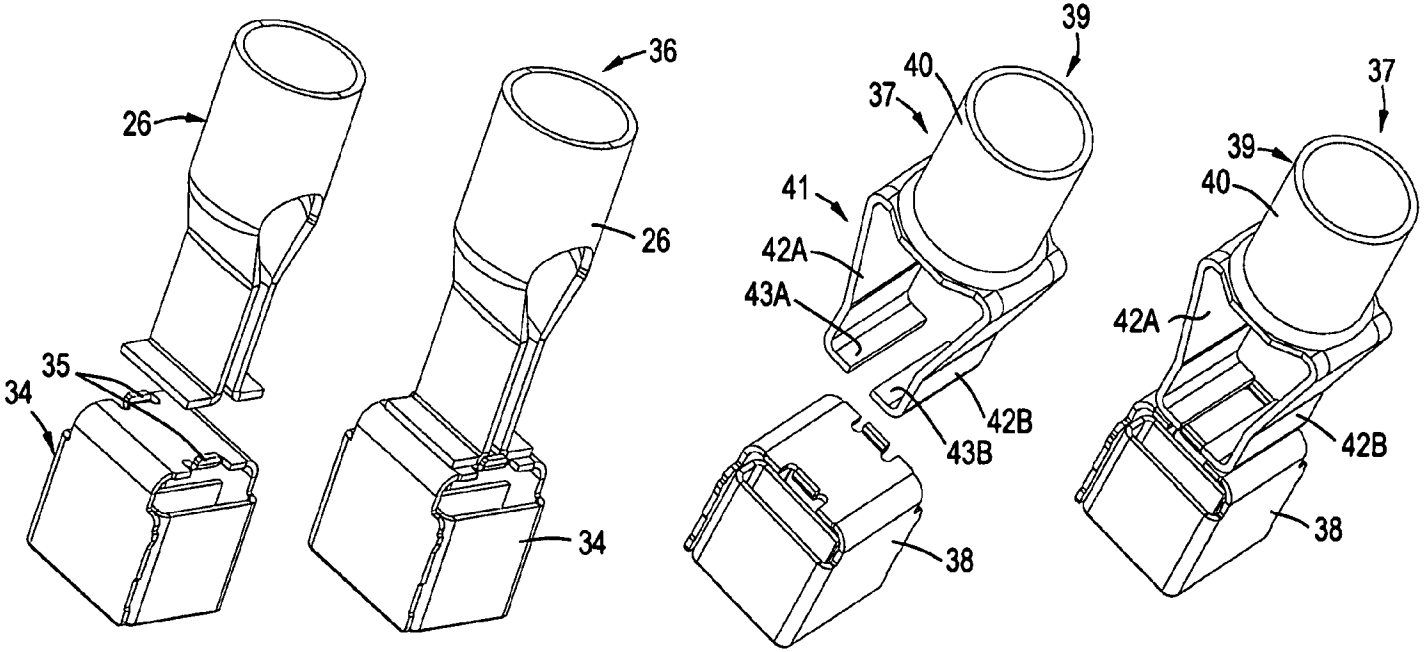

FIGS. 22A-22F show different stages of manufacturing a straight contact, e.g. a contact 101 or 301. FIG. 22A shows a generally cylindrical member 26 having a tubular portion 27 and a segmented portion 28, here having two segments 29A, 29B. The cylindrical member 26 may be a rolled sheet or, preferably, a hollow tube, e.g. of metal. In a next step, the segmented portion 28 is flattened, forming a shaft section wherein segments 29A, 29B form two legs 29A, 29B, and resulting in a transition portion 30 in-between the segmented shaft portion 28 and the tubular portion 27 (FIG. 22B). Then, feet 31A, 31B are formed by bending portions of the legs 29A, 29B outwards near their tips, away from each other (FIG. 22C). In the thus formed member 26 openings 32 may remain, which may be useful for manipulating a finished contact, e.g. soldering, or for air cooling the finished contact. These forming steps (FIGS. 62A-62C) may be performed substantially parallel to each other in a combined forming process, e.g. using a number of forming dies 33A-33D as shown in cross section in FIG. 22D. In a separate process a contact box 34 is formed, e.g. by stamping and folding a sheet of material such as metal. The formed member 26 and the contact box 34 are then arranged in a desired relative position (FIG. 22E), here again with the assistance of upturned tabs 35 fitting around the feet 31A, 31B of the formed member 26 (FIGS. 22E, 22F). Then the parts 26, 34 are attached to each other for forming a finished contact 36 (FIG. 22F). The contact may be coated partially or wholly and/or be insulated on the outside.

FIGS. 23A-23B show (assembly of) an alternative straight contact 37, comprising a contact portion 38 and a crimping member 39 having a crimping barrel 40 and an open shaft section 41 with two separated legs 42A, 42B with inward bent feet 43A, 43B. The legs and feet 42A-43B may be sized such that in one orientation the feet 43A, 43B fit around alignment structures 44 of the contact portion 38, whereas in a 90 degree rotated situation the legs and feet 42A-43B fit in-between the structures 44, e.g. for fitting the contact 37 to a particular terminal housing design.

Thus, several different types of crimp barrels can be produced, such as D-crimp, closed barrel, etc., and different shapes like round, square, hexagon, etc. A contact can also be made of separate parts welded or soldered together. Both said parts can be made of materials with different material properties which fit best to the function of this part, e.g. connecting, conducting, clamping, crimping, etc. The crimp barrel can also be made of an extruded part as well, then a shaft section may suitably comprise a single leg. The pictures show angled crimped versions and straight crimping versions but more variations, e.g. different angles, are possible.

With the invention, an electrical contact can be provided with low electrical resistance since the contact may be unitary or may otherwise be soldered, welded, no clean process is required (no liquid or powder flux need be used) required for soldering, and which is able to connect to different copper alloys to form the contact. The invention can also comprise an ability to connect plated surfaces, an inexpensive manufacturing process, flexibility in shapes of barrels and contacts, and a process which is controllable. The process could include, for example, resistance hard soldering, ultrasonic metal welding, spot welding (resistance welding), inductive hard soldering, laser welding, and laser spot welding. Hard soldering without flux can be used as a connection technology. Common used hard soldering process use heat sources such as flame, induction, oven, or resistance welding equipment. The present contact can be hard soldered with use of a resistance welding machine to heat up parts by means of a high current. This current creates, at the point of high resistance, heat. The system can make use of special electrodes made out of TZM which has a high resistance in combination with a good heat transfer coefficient. This gives smoother heat conduction in the solder joint. A suitable heat conduction time is around one second. The solder material used can be Brazetec S15 which is usually used to soldered copper alloys with a high content of copper. This soldered material gives, besides good soldered joints on copper, excellent results on Au plated and Sn plated materials, which is a big advantage: crimp barrels are normally Sn plated.

Additional advantages include the fact that no flux needs to be used, so there is no contamination and there is no cleaning required, high strength is provided, low electrical resistance is provided, and a preformed solder member can be used.

In regard to quality, the resistance hard soldering Technology has advantages due to the high state of technology of the equipment. Civil process parameters can be monitored. The soldered joint is very good recognizable and expectable by its typical surface appearance, and the construction of the solder joint surfaces. The product is also recognizable by the look of the barrel surface, which is galvanized Sn reflowed by the soldering operation.

It should be understood that the foregoing description is only illustrative of the invention. Various alternatives and modifications can be devised by those skilled in the art without departing from the invention.

The invention claimed is:

1. Electrical contact, comprising a mating end and a conductive section, where the mating end comprises at least two spaced contact receiving sections configured to each respectively receive one of at least two mating contacts of a mating connector, and the conductive section including: a crimping end which is adapted to receive an electrical conductor and for being crimped thereto and a shaft section, wherein the shaft section extends between the crimping end and the mating end and includes two legs;

wherein the mating end comprises an opening for receiving a protrusion of a connector cover.

2. Contact according to claim 1, wherein the mating end is a single folded piece of material.

3. Contact according to claim 1, wherein the mating end and the conductive section are one piece, e.g. a single folded piece of material.

4. Method for manufacturing an electrical contact according to claim 3, comprising the steps of providing a piece of conductive material, forming a first portion of the material, e.g. by folding, into a crimping end which is adapted to receive an electrical conductor and for being crimped thereto, and a shaft section which includes two legs, and forming a second portion of the conductive material into a mating end adapted for mating to two or more contacts.

5. Contact according to claim 1, wherein the contact comprises at least a first and a second member mounted one on the other, the first member comprising the mating end and the second member comprising the conductive section.

6. Contact according to claim 5, wherein the first member and/or the second member comprises structures adapted for assisting positioning the members with respect each other for assembly of the contact.

7. Contact according to claim 1, wherein at least one of the legs comprises at least one foldable tab adapted for holding together both legs.

8. Method for manufacturing a power connector contact according to claim 1, the method comprising the steps of providing a first piece of conductive material, forming the first piece of conductive material by folding, into a first member forming a front mating end, providing a second piece of conductive material, forming the second piece of conductive material connecting with the first piece of the conductive material and by folding, into a second member forming the crimping end which is adapted to receive an end of an electrical conductor and for being crimped thereto, and the shaft section which includes two legs, and mounting the first and second members to another comprising soldering or welding.

9. Connector comprising a contact according to claim 1.

10. Connector according to claim 9, comprising a terminal housing having a cavity receiving the contact and a connector cover, wherein the cover has a protrusion adapted for penetrating through the terminal housing and through an opening of the contact, therewith trapping the contact inside the cavity in the housing.

11. Electrical contact, comprising a first member and a second member mounted to each other by a soldered connection or ultrasonic welding, wherein the first member forms a front mating end of the contact and the second member forms a rear end of the contact, where the mating end comprises at least two spaced contact receiving sections configured to each respectively receive one of at least two mating contacts of a mating connector, wherein the second member has a crimping end adapted to receive an electrical conductor and to be crimped onto the conductor;

wherein the second member has a shaft section adapted for connecting the crimping end and the mating end which shaft section includes two legs.

12. Contact according to claim 11, wherein at least one of the legs comprises at least one foldable tab adapted for holding together both legs.

13. Contact according to claim 11, wherein the mating end is a single folded piece of material.

14. Contact according to claim 11, wherein the first member and/or the second member comprises structures adapted for assisting positioning the members with respect each other for assembly of the contact.

15. Contact according to claim 11, wherein the contact is arranged for connecting two or more contacts.

16. Contact according to claim 11, wherein the mating end comprises an opening for receiving a protrusion of a connector cover.

17. Electrical contact, comprising a first member and a second member mounted to each other by a soldered connection or ultra sonic welding, wherein the first member forms a front mating end of the contact and the second member forms a rear end of the contact, wherein the first member is a single folded piece of material adapted for mating to two or more contacts, where the first member comprises at least two spaced contact receiving sections configured to each receive a respective different mating blade of a mating connector, and wherein the second member has a crimping end and a shaft section, the crimping end being adapted to receive an electrical conductor and to be crimped onto the conductor, the shaft section extending between the crimping end and the mating end and including two legs.

* * * * *